US005655611A

United States Patent [19]

Dolezal et al.

[11] Patent Number: 5,655,611

[45] Date of Patent: Aug. 12, 1997

[54] EARTH-BORING BIT WITH IMPROVED BEARING SEAL

[75] Inventors: George E. Dolezal, Friendswood; Thomas M. Harris, Conroe, both of Tex.

[73] Assignee: Baker Hughes Inc., Houston, Tex.

[21] Appl. No.: 511,509

[22] Filed: Aug. 4, 1995

[51] Int. Cl.[6] ..... E21B 10/22

[52] U.S. Cl. ..... 175/371

[58] Field of Search ..... 175/371, 372

[56] References Cited

U.S. PATENT DOCUMENTS

| | | | |
|---|---|---|---|
| 3,365,247 | 1/1968 | Ferrand | 175/372 X |
| 3,397,928 | 8/1968 | Galle | 308/8.2 |
| 3,449,024 | 6/1969 | Lichte | 175/371 X |
| 3,765,495 | 10/1973 | Murdoch et al. | 175/371 |
| 4,014,595 | 3/1977 | Dolezal | 384/73 |
| 4,209,890 | 7/1980 | Koskie, Jr. | 175/371 X |
| 4,372,624 | 2/1983 | Neilson | 384/94 |
| 4,428,687 | 1/1984 | Zahrdnik | 384/94 |
| 4,516,641 | 5/1985 | Burr | 175/228 |
| 4,554,985 | 11/1985 | Backlund | 75/371 |
| 4,557,609 | 12/1985 | Moren | 384/94 |
| 4,623,028 | 11/1986 | Murdoch et al. | 175/371 |
| 4,727,942 | 3/1988 | Galle et al. | 175/228 |
| 4,753,303 | 6/1988 | Burr | 175/372 X |
| 4,753,304 | 6/1988 | Kelly, Jr. | 175/371 |
| 4,923,020 | 5/1990 | Kelly, Jr. et al. | 175/372 |
| 4,955,440 | 9/1990 | Chavez | 175/371 |
| 5,129,471 | 7/1992 | Maurstad et al. | 175/228 |
| 5,485,891 | 1/1996 | Vladimirovich et al. | 175/372 |

*Primary Examiner*—William P. Neuder

*Attorney, Agent, or Firm*—Robert A. Felsman; Mark D. Perdue

[57] ABSTRACT

An earth-boring bit has a bit body and at least one bearing shaft depending inwardly and downwardly from the bit body. The bearing shaft has a base and a generally cylindrical bearing surface and at least one cutter is mounted for rotation on the bearing shaft. A bearing seal recess is formed generally at the base of the bearing shaft and defines a cylindrical seal face radially recessed from the journal bearing surface. A cutter seal recess is formed in the cutter generally opposite the bearing seal recess and defines a bearing cylindrical seal face. The cutter and bearing seal recesses define a seal gland including a pair of opposed radial seal surfaces. A resilient seal ring is disposed in the seal gland and compressed between the cylindrical seal faces.

11 Claims, 2 Drawing Sheets

EARTH-BORING BIT WITH IMPROVED BEARING SEAL

BACKGROUND OF THE INVENTION

1. Field of the Invention

The present invention relates in general to earth-boring bits, particularly to those having rotatable cutters in which seal rings retain lubricant within the bearing areas.

2. Background Information

One of the most successful seal means used in earth boring bits of the type having rotatable cutters is the O-ring seal. It successfully confines lubricant to the bearing area while excluding detritus for long periods of time before failure.

There are two general categories of O-ring seal utilized in earth bring bits: (1) those permitting axial motion or play of the O-ring; and (2) those utilizing a recess to retain the seal in one position relative to either the cutter or bearing shaft, usually the cutter.

Examples of those earth-boring bits with seals permitting axial motion relative to the bearing shaft or cutter are U.S. Pat. Nos. 3,397,928; 4,014,595 and 4,516,641. Examples of those seals confined in one position relative to the cutter are U.S. Pat. Nos. 3,765,495; 4,372,624 and 4,554,985.

The primary advantage of those O-ring seals permitting axial motion is the minimization of pressure pulses in the lubricant. Pressure pulses adjacent the seal can be detrimental and can result in leakage of lubricant or damage to the seal unless there is sufficient play of the seal in the recess to avoid extrusion. A sufficient amount of play reduces the magnitude of the pressure pulses to prevent extrusion of the O-ring from the seal recess (commonly called the "gland.")

The advantages of those seal systems in which the seal is confined in one position, usually the cutter, are: (1) protecting the seal from abrasives that cause wear and deterioration, (2) biasing the seal to keep the seal with the cutter to minimize pressure pulses and (3) preventing the pressure pulses in the lubricant from pushing the O-ring with excessive force against the stationary seal surface on the body of the bit.

SUMMARY OF THE INVENTION

It is a general object of the present invention to provide an earth-boring bit having an improved pressure-compensating bearing seal.

This and other objects of the present invention are achieved by providing an earth-boring bit having a bit body and at least one bearing shaft depending inwardly and downwardly from the bit body. The bearing shaft has a base and a generally cylindrical bearing surface and at least one cutter is mounted for rotation on the bearing shaft. A bearing seal recess is formed generally at the base of the bearing shaft and defines a cylindrical seal face radially recessed from the journal bearing surface. A cutter seal recess is formed in the cutter generally opposite the bearing seal recess and defines a bearing cylindrical seal face. The cutter and bearing seal recesses define a seal gland including a pair of opposed radial seal surfaces. A resilient seal ring is disposed in the seal gland and compressed between the cylindrical seal faces.

According to the preferred embodiment of the present invention, a shroud extends inwardly from the cutter seal recess and opposes the cutter radial seal surface to bias the seal ring into the seal gland.

According to the preferred embodiment of the present invention, the seal ring is circular in cross section and has a compressed length less than the minimum distance between the radial seal faces.

DESCRIPTION OF THE PREFERRED EMBODIMENT

Figure 1:
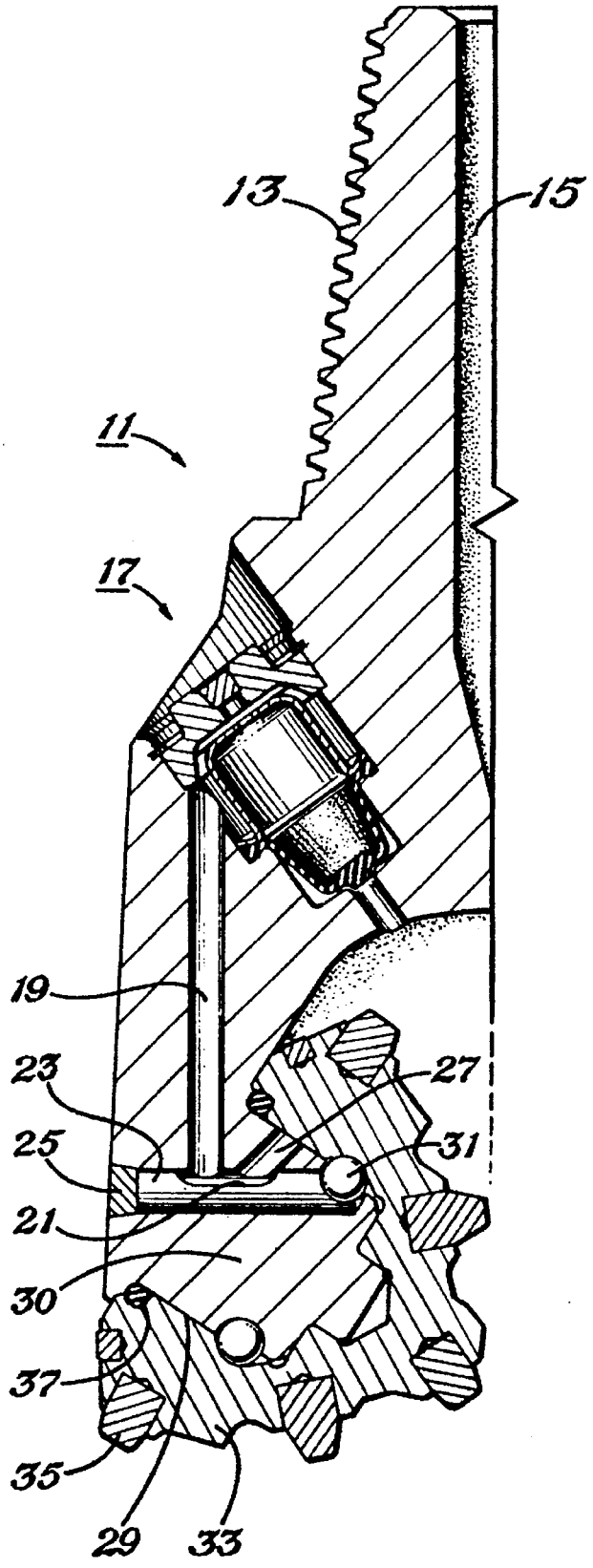
FIG. 1 is a longitudinal section view of one section of the bit body of an earth-boring bit according to the present invention.

The numeral 11 in FIG. 1 of the drawing designates an earth-boring bit having a threaded upper portion 13 for connection to a drill string member (not shown). A fluid passage 15 directs drilling fluid to a nozzle (not shown) that impinges drilling fluid against the borehole bottom to flush cuttings to the surface of the earth.

A pressure compensating system 17 is contained within each section of the body, there usually being three, which are welded to form the composite body. The lubrication system is preferably similar to that shown in U.S. Pat. No. 4,727,942.

In each section of the body is a lubrication passage 19 that extends downwardly into intersection with another lubrication passage. 21 in the upper portion of a ball plug 23, which is secured to the body by a plug weld 25. A third lubrication passage 27 carries lubricant to a cylindrical bearing surface 29 on a bearing shaft 30, which is cantilevered downwardly and inwardly from an outer and lower region of the body of the bit.

Ball plug 23 retains a series of ball bearings 31 that rotatably secure the cutter 33 to the bearing shaft 30. Dispersed in the cutter are a plurality of rows of earth disintegrating cutting elements or teeth 35 that are constructed of a sintered tungsten carbide secured by interference fit into mating holes in the cutter 33.

Figure 2:
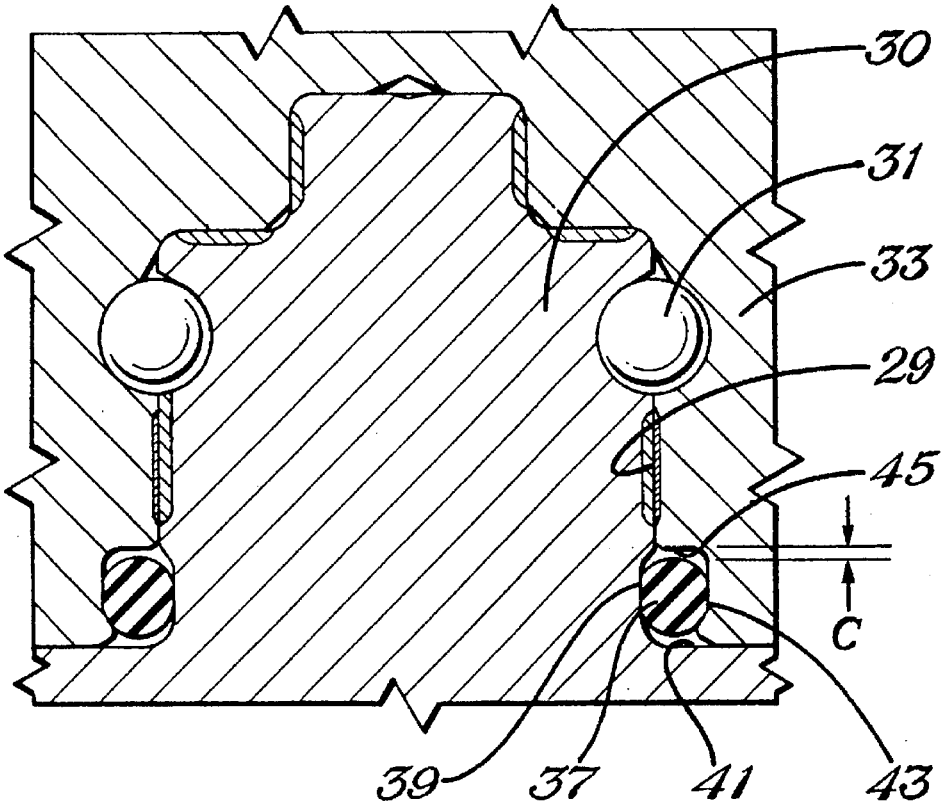
FIG. 2 is an enlarged, fragmentary longitudinal section view of the bearing shaft and seal according to the present invention.
Figure 3:
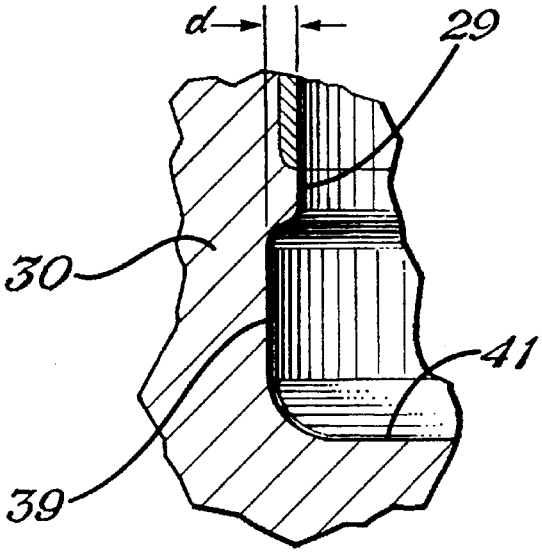
FIG. 3 is an enlarged, fragmentary section view of the cutter seal recess according to the present invention.
Figure 4:
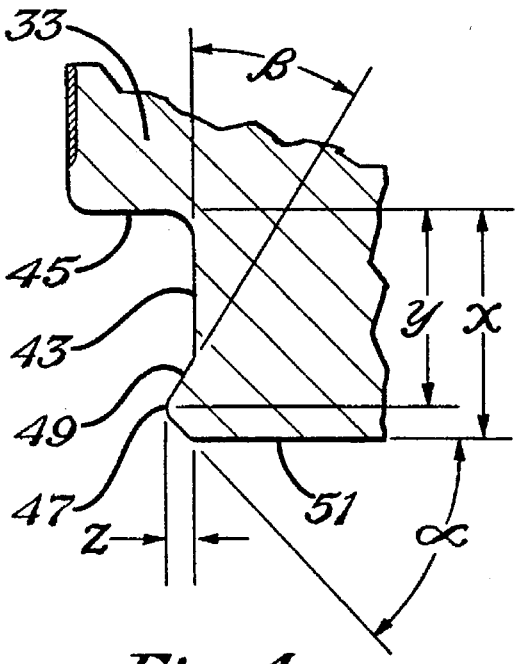
FIG. 4 is an enlarged, fragmentary section view of the seal bearing recess of the earth-boring bit according to the present invention.

FIG. 2 is an enlarged section view of the bearing and seal assembly of the earth-boring bit according to the present invention. FIGS. 3 and 4 are enlarged section views depicting the surfaces defined by the seal recesses formed in bearing shaft 30 and cutter 33. A bearing seal recess is formed at the base of bearing shaft 30 and is radially recessed from journal bearing surface 29. The bearing recess defines a cylindrical seal surface 39 adjacent the last-machined surface of the bit body, which serves as a radial seal face (as described below, surface 41 is not anticipated to actually function as radial seal surface).

A cutter seal recess is formed in the mouth of cutter 33 so as to be arranged opposite from the bearing seal recess when cutter 33 is assembled upon bearing shaft 30. Cutter seal recess defines a cylindrical seal surface 43 adjacent a radial seal surface 45. Cylindrical seal surfaces 39, 43 and radial seal surfaces 41, 45 define a seal gland in which a resilient O-ring 37 is compressed. According to the preferred embodiment of the present invention, the O-ring is compressed to yield a "squeeze" on the O-ring of about 10–15% of its cross-sectional diameter in a relaxed, uncompressed state. The overall length of the seal gland (distance between radial seal faces 41, 45) is selected to provide a clearance C sufficient to permit compressed O-ring 37 to move back and forth within the seal gland to compensate for pressure differences in the lubricant and minimize pressure pulses that otherwise tend to push O-ring 37 outwardly in a manner to cause excessive heat, wear, or extrusion. Thus, the distance between radial seal surfaces is selected to be larger than the compressed length 1 of O-ring 37 by a selected amount C.

A beveled shroud 47 extends into the seal gland from backface 51 of cutter 33 and includes an inward inclined surface 49, which engages O-ring 37 to bias it inwardly and away from radial seal surface 41. Beveled shroud 47 should not extend inwardly past cylindrical seal surface 43 more than about 30% of the cross-sectional diameter of O-ring in its relaxed condition to avoid unduly confining O-ring 37 against movement responsive to pressure pulses. Preferably, beveled shroud 47 extends inwardly beyond cylindrical seal surface 43 a distance not to exceed 8% of the cross-sectional diameter of the O-ring in its relaxed condition to facilitate assembly.

According to the preferred embodiment of the present invention, the preferred dimensions of the seal gland are as follows:

C=0.15 D;
X=1.4 D;
Y=1.2 D;
Z=0.08 D;
$\alpha$=30°;
$\beta$=30°; and
d=0.2 D.

Where:

C is the difference in the length of the compressed seal ring 37 and the minimum length of the seal gland or distance between radial seal surfaces 41, 45.

X is the distance from the cutter backface 51 to radial seal surface 45.

Y is the distance from beveled shroud 47 to radial seal surface 45.

Z is the distance shroud 47 extends inwardly from cylindrical seal surface 43.

$\alpha$ is the angle of the outward inclined surface of beveled shroud 47.

$\beta$ is the angle of inward inclined surface 49 of beveled shroud 47.

D is the cross-sectional diameter of O-ring 37 in its relaxed condition; and d is the depth of the bearing seal recess relative to journal bearing surface 29.

Bits constructed as set forth above provide better protection of the seal ring from abrasive wear. Partially recessing the seal ring in the bearing shaft provides a lower sliding velocity as the seal ring rotates with the cutter and further permits the use of seal rings having larger cross-sectional diameters and better ability to resist wear, without unduly weakening the bearing shaft with the stress concentrations associated with deep recesses.

The invention has been described with reference to preferred embodiments thereof. It is thus not limited, but is susceptible to variation and modification without departing from the scope of the invention.

We claim:

1. An earth-boring bit comprising:

a bit body;

at least one bearing shaft depending inwardly and downwardly from the bit body, the bearing shaft having a base and a generally cylindrical journal bearing surface;

at least one cutter mounted for rotation on the bearing shaft;

a bearing seal recess formed generally at the base of the bearing shaft, the bearing seal recess defining a cylindrical seal face radially recessed from the journal bearing surface;

a cutter seal recess formed in the cutter generally opposite the bearing seal recess and defining a cylindrical seal face, the cutter and bearing seal recesses defining a seal gland including a pair of opposed radial seal surfaces; and a resilient seal ring disposed in the seal gland and compressed between the cylindrical seal faces.

2. The earth-boring bit according to claim 1 wherein the seal ring is circular in cross section.

3. The earth-boring bit according to claim 1 wherein a shroud extends inwardly from the cutter and opposite the cutter radial seal surface to bias the seal ring into the seal gland.

4. The earth-boring bit according to claim 1 wherein the seal ring has a compressed length less than the distance between the radial seal surfaces.

5. An earth-boring bit comprising:

a bit body;

at least one bearing shaft depending inwardly and downwardly from the bit body, the bearing shaft having a base and a generally cylindrical journal bearing surface;

at least one cutter mounted for rotation on the bearing shaft, the cutter including a backface;

a bearing seal recess formed generally at the base of the bearing shaft, the bearing seal recess defining a cylindrical seal face radially recessed from the journal bearing surface;

a cutter seal recess formed in the cutter generally opposite the bearing seal recess and defining a cylindrical seal face and a radial seal face adjacent the cylindrical seal face, the cutter and bearing seal recesses defining a seal gland; and a resilient seal ring disposed in the seal gland and compressed between the cylindrical seal faces.

6. The earth-boring bit according to claim 5 wherein the seal ring is circular in cross section.

7. The earth-boring bit according to claim 5 further comprising:

a shroud extending inwardly from the cutter and opposite the radial seal surface to bias the seal ring into the seal gland.

8. The earth-boring bit according to claim 1 wherein the seal ring has a compressed length less than the distance between the radial seal surfaces.

9. An earth-boring bit comprising:

a bit body;

at least one bearing shaft depending inwardly and downwardly from the bit body, the bearing shaft having a base and a generally cylindrical journal bearing surface;

at least one cutter mounted for rotation on the bearing shaft, the cutter including a backface;

a bearing seal recess formed generally at the base of the bearing shaft, the bearing seal recess defining a cylindrical seal face radially recessed from the journal bearing surface and an adjacent bearing radial seal surface;

a cutter seal recess formed in the cutter generally opposite the bearing seal recess and defining a cylindrical seal face and a cutter radial seal face adjacent the cylindrical seal face, the cutter and bearing seal recesses defining a seal gland; and a resilient seal ring disposed in the seal gland and compressed between the cylindrical seal faces, the seal ring having a compressed length less than the distance between the radial seal surfaces.

10. The earth-boring bit according to claim 9 wherein the seal ring is circular in cross section.

11. The earth-boring bit according to claim 9 further comprising:

a shroud extending inwardly from the cutter and opposite the cutter radial seal surface to bias the seal ring into the seal gland.

* * * * *